US008350759B2

(12) United States Patent
Ju et al.

(10) Patent No.: US 8,350,759 B2
(45) Date of Patent: Jan. 8, 2013

(54) ANTENNA HAVING METAMATERIAL SUPERSTRATE AND PROVIDING GAIN IMPROVEMENT AND BEAMFORMING TOGETHER

(75) Inventors: Jeong Ho Ju, Seoul (KR); Dong Ho Kim, Daejeon (KR); Jae Ick Choi, Daejeon (KR); Wang Joo Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 222 days.

(21) Appl. No.: 12/634,276

(22) Filed: Dec. 9, 2009

(65) Prior Publication Data

US 2010/0277374 A1 Nov. 4, 2010

(30) Foreign Application Priority Data

Apr. 29, 2009 (KR) ..... 10-2009-0037821

(51) Int. Cl.
*H01Q 1/38* (2006.01)

(52) U.S. Cl. ..... 343/700 MS; 343/909; 343/872

(58) Field of Classification Search ..... 343/700 MS, 343/909, 872

See application file for complete search history.

(56) References Cited

U.S. PATENT DOCUMENTS

| | | | | |
|---|---|---|---|---|
| 5,923,290 | A | 7/1999 | Mikami et al. | |
| 7,319,429 | B2 | 1/2008 | Chang et al. | |
| 2005/0099338 | A1* | 5/2005 | Noro et al. | 343/700 MS |
| 2008/0001843 | A1* | 1/2008 | Wu et al. | 343/873 |

FOREIGN PATENT DOCUMENTS

KR 1020040008983 A 1/2004

OTHER PUBLICATIONS

J. Ju, et al; "Fabry-Pérot cavity antenna with lateral metallic walls for WiBro base station applications", Electronics Letters, Jan. 29, 2009, vol. 45, No. 3, pp. 141-142.

Andrew R. Weily, et al; "High-Gain 1D EBG Resonator Antenna", Microwave and Optical Technology Letters, vol. 47, No. 2, Oct. 20, 2005, pp. 107-114.

Nicolas Guérin, et al "A Metallic Fabry-Perot Directive Antenna", IEEE Transactions on Antennas and Propagation, vol. 54, No. 1, Jan. 2006 (exact date not given), pp. 220-224.

* cited by examiner

*Primary Examiner* — Dieu H Duong
(74) *Attorney, Agent, or Firm* — Ladas & Parry LLP

(57) ABSTRACT

Provided is antenna having metamaterial and providing gain improvement and beamforming together. The antenna includes a resonator and a superstrate. A feed antenna is disposed in the resonator. The superstrate includes a conductive pattern on the resonator for improving gain and beamforming of the feed antenna.

20 Claims, 7 Drawing Sheets

ANTENNA HAVING METAMATERIAL SUPERSTRATE AND PROVIDING GAIN IMPROVEMENT AND BEAMFORMING TOGETHER

CROSS-REFERENCE TO RELATED PATENT APPLICATION

This application claims the benefit of Korean Patent Application No. 10-2009-0037821, filed on Apr. 29, 2009, in the Korean Intellectual Property Office, the disclosure of which is incorporated herein in its entirety by reference.

BACKGROUND OF THE INVENTION

1. Field of the Invention

The present invention relates to an antenna, and more particularly, to an antenna having a metamaterial superstrate and providing gain improvement and beamforming together.

2. Description of the Related Art

An array antenna, which may be formed by arranging a plurality of patch antennas, is generally used in cases where high-gain radiation characteristics and beam formation are necessary, such as in a base station.

However, as the number of array elements in an array antenna increases, energy loss due to antenna feeds also increases in proportion to the number of antenna feed points. Thus, overall efficiency of an antenna is decreased. Furthermore, it is necessary to precisely adjust both intervals between patch antennas and phases of signals fed to the patch antennas to obtain suitable gain and radiation pattern. Thus, the structure of such an array antenna becomes complicated.

Examples of antennas having higher antenna gain include an electromagnetic bandgap (EBG) type antenna, which is formed by arranging high-k materials in a predetermined interval on top of the antenna, and an antenna of Fabry-Perot resonator, which is formed by disposing a dielectric substrate of a metallic periodic structure on a typical patch antenna.

Such antennas have advantages of a simple feed structure and gain increase using a single feed point compared to that of an array antenna, but have a difficulty in beamforming.

SUMMARY OF THE INVENTION

The present invention provides an antenna that includes a metamaterial superstrate and a metal wall surrounding a structure of the antenna that exhibits a high antenna gain and a low front-to-back ratio (FBR) over a wide band of frequencies and is capable of forming a beam having a desired width. According to an aspect of the present invention, there is provided an antenna having a metamaterial superstrate and providing gain improvement and beamforming together. The antenna includes a resonator and a superstrate. A feed antenna is disposed in the resonator. The superstrate includes a conductive pattern on the resonator for improving gain and beamforming of the feed antenna.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
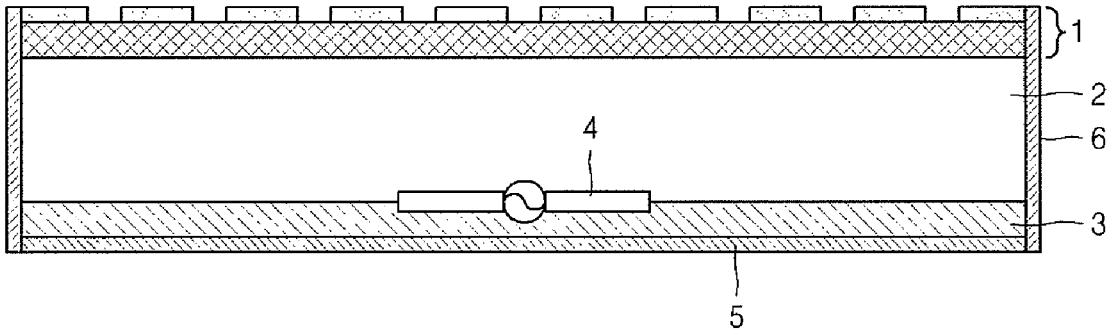
FIG. 1 is a sectional view of an antenna having a superstrate, according to an embodiment of the present invention.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, anything unnecessary for describing the present invention are omitted for clarity. Like reference numerals in the drawings denote like elements, and thus their description will be omitted.

FIG. 1 is a sectional view of an antenna having a superstrate, according to an embodiment of the present invention. The antenna includes a superstrate 1, a resonator 2, a dielectric base 3, a feed antenna 4 disposed inside the resonator 2 or on the dielectric base 3, a ground panel 5 and metal walls 6 that are disposed on sidewalls of the antenna.

Here, the feed antenna 4 is for feeding the antenna, and may be any type antenna capable of feeding the antenna, for example, a patch antenna, a dipole antenna, a slot antenna, or a waveguide antenna. Although FIG. 1 shows that the feed antenna 4 is disposed on the dielectric base 3, the feed antenna 4 may instead be disposed at the center of or on top of the resonator 2.

Figure 2:
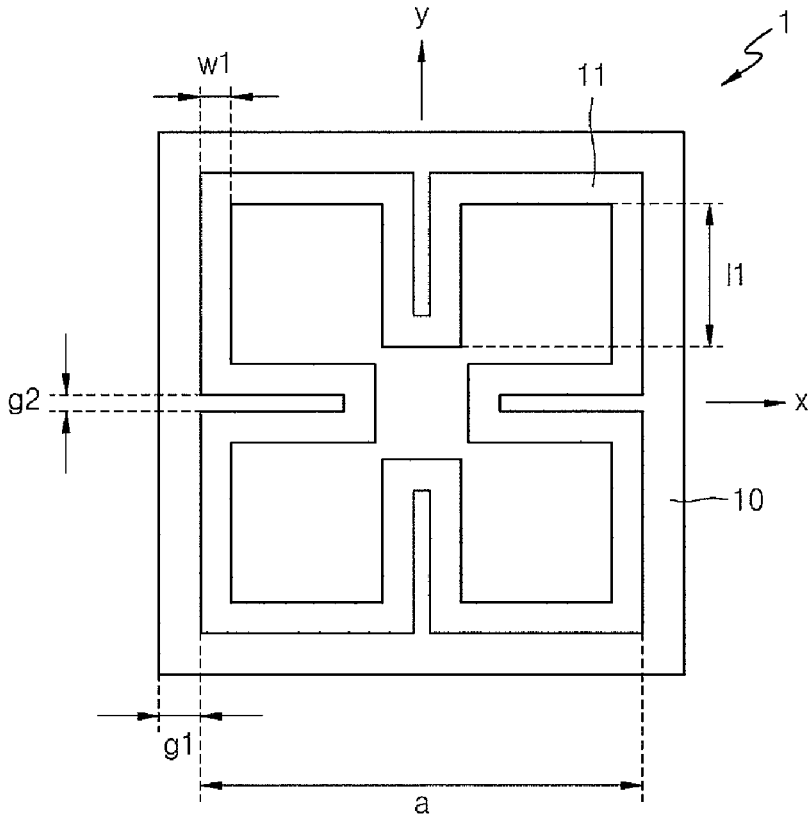
FIG. 2 shows a conductive structure of the superstrate.
Figure 3A:
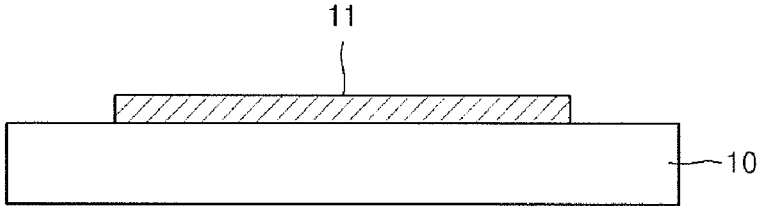
FIGS. 3A and 3B illustrate conductive structures disposed on a top portion or on top and bottom portions of the dielectric substrate.
Figure 3B:
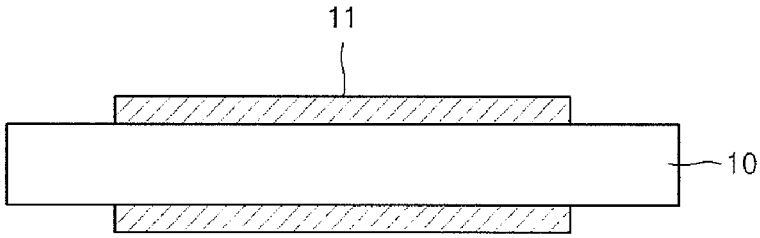

FIG. 2 shows a conductive structure of the superstrate 1 of FIG. 1. The superstrate 1 includes a dielectric substrate 10 and a conductive pattern 11. The dielectric substrate 10 includes a typical dielectric medium, and the conductive pattern 11 is formed on the top portion or both the top and bottom portions of the dielectric substrate 10 as shown in FIGS. 3A and 3B.

Although the shape of the conductive pattern 11 shown in FIG. 2 is a square, opposite sides of which are symmetrically rugged, the present invention is not limited thereto and the conductive pattern 11 may have any of various shapes. The conductive pattern 11, each side of which has a predetermined width W1, is arranged along with edges of the dielectric substrate 10 and a predetermined interval g1 apart from the edges of the dielectric substrate 10, and includes rectangular concave portions. Each of the concave portions is formed such that two parallel sides are of a predetermined length l1 and a predetermined interval g2 apart from each other, and the concave portions directed toward the center of the dielectric substrate 10 form a square. Thus, due to the rectangular concave portions, five squares are formed by the conductive pattern 11.

Figure 4:
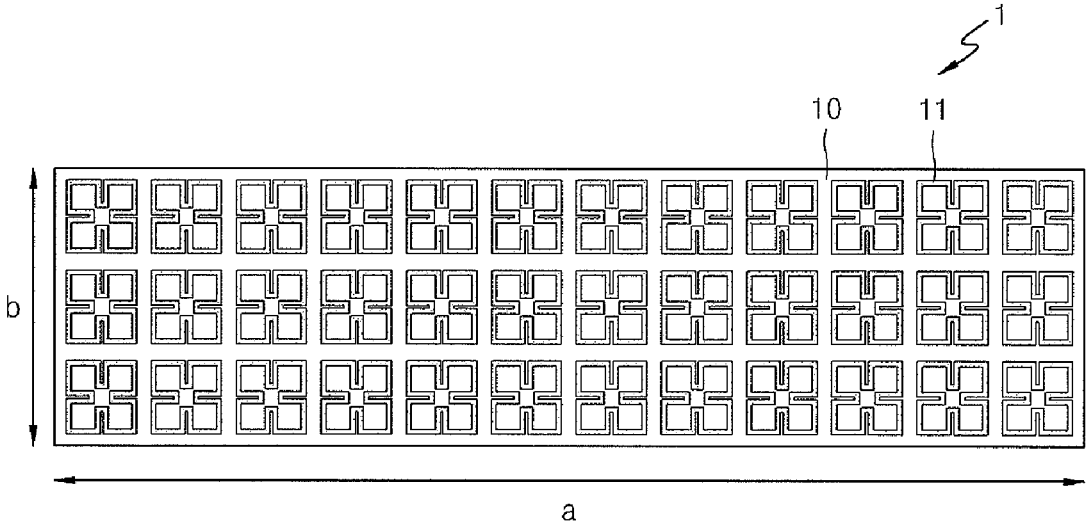
FIG. 4 shows that a plurality of the conductive patterns are arranged on the entire superstrate.

FIG. 4 shows that a plurality of the conductive pattern 11 shown in FIG. 3 are arranged on the entire superstrate 1, wherein the conductive pattern 11 shown in FIG. 3 is a unit pattern. In FIGS. 4, *a* and *b* indicate length and width of the superstrate 1, respectively, wherein an antenna beam width may be adjusted according to the values of a and b. Furthermore, antenna gain may be adjusted according to the value of each of the parameters g1, g2, w1, and l1 of the conductive pattern 11.

Figure 5:
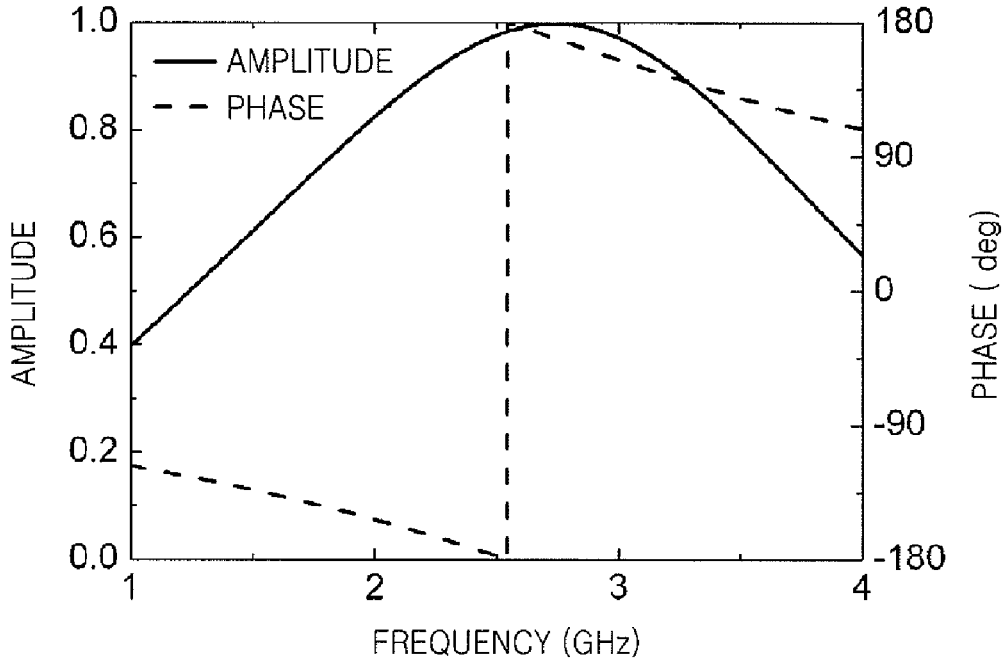
FIG. 5 shows reflection phase and amplitude of a reflection coefficient of a unit pattern arranged on the superstrate.

FIG. 5 shows reflection phase and amplitude of a reflection coefficient of a unit pattern arranged on the superstrate 1. In FIG. 5, the solid line indicates the amplitude of the reflection coefficient, whereas the dotted line indicates the reflection phase. FIG. 5 shows that the reflection coefficient has a maximum value and the reflection phase is reversed at resonance frequencies close to 2.5 GHz. The reflection phase is an important factor for determining antenna resonance frequency and a distance between a ground panel and a unit pattern.

Figure 6:
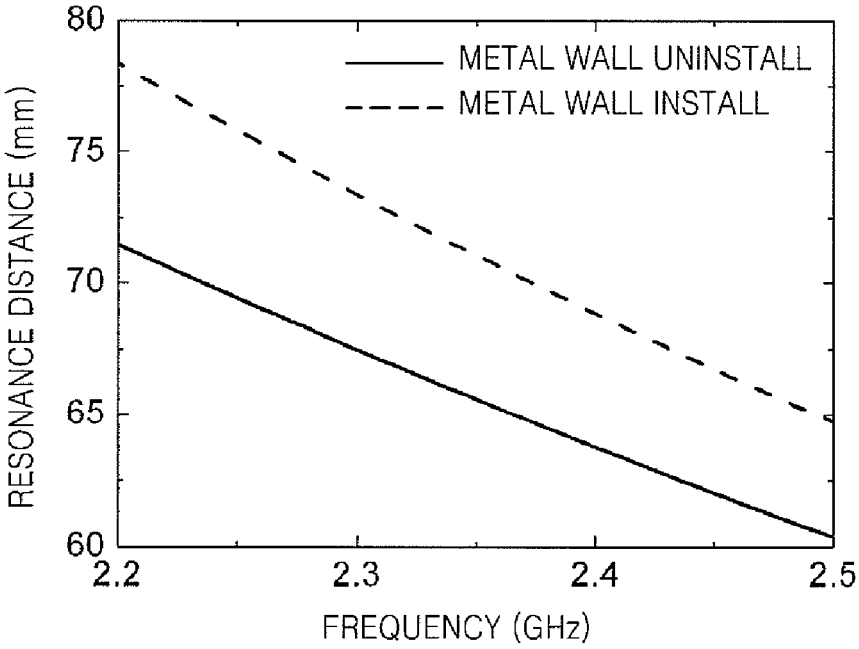
FIG. 6 shows a relationship between a resonance distance and a resonance frequency of an antenna based on whether the metal walls 6 are installed or not.

FIG. 6 shows a relationship between a resonance distance and a resonance frequency of an antenna based on whether the metal walls 6 are installed or not. In FIG. 6, the solid line indicates a case when the metal walls 6 are not installed, whereas the dotted line indicates a case when the metal walls 6 are installed. As shown in FIG. 6, the resonance distance becomes longer when the metal walls 6 are installed.

The resonance frequencies of the antenna with respect to the resonance distance in cases when the metal walls 6 are not installed and in cases when the metal walls 6 are installed may respectively be calculated as shown below.

$$f_{fp} = \frac{c}{2h} \times \left( \frac{\phi_{prs} + \phi_{ground}}{2\pi} + p \right),\ p = 0, 1, 2, 3 \ldots \qquad \text{[Equation 1]}$$

$$f_{mnp} = \frac{c}{2\pi} \sqrt{kx^2 + ky^2 + kz^2},\ kx = \frac{m\pi}{a},\ ky = \frac{n\pi}{b},$$

$$kz = 2\pi f_{fp} \sqrt{\mu\varepsilon}$$

Here, c indicates speed of light, h indicates a distance between a ground panel and a unit pattern, that is, a resonance distance, and a and b respectively indicate a length and width of the antenna surrounded by the metal walls. $\phi_{prs}$ and $\phi_{ground}$ respectively indicate reflection phases of the unit pattern and the ground panel. μ and ∈ respectively indicate permittivity and permeability of an internal medium surrounded by the metal walls.

According to Equation 1, the resonance frequency is inversely proportional to the resonance distance in cases when the metal walls 6 are not installed. In cases when the metal walls 6 are installed, the resonance frequency varies according to a size of the superstrate 1 and height of the metal walls 6. Resonance frequency may vary according to factors other than the parameters stated above, for example, a width or length of the rectangular concave portions shown in FIG. 2.

Figure 7:
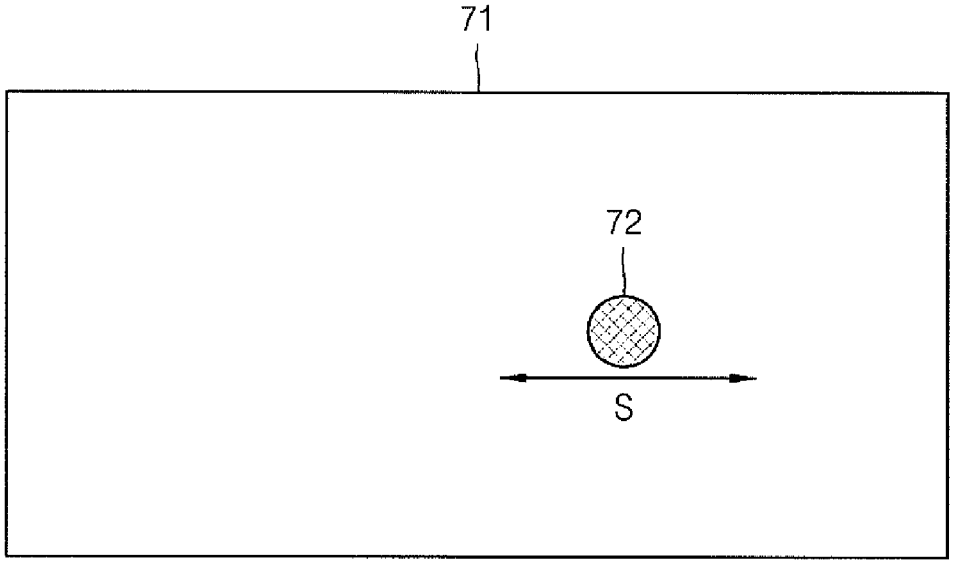
FIG. 7 shows a configuration of a patch antenna and a feeding point for feeding an antenna.

FIG. 7 shows a configuration of a patch antenna 71 and a feeding point 72 for feeding an antenna. Matching and gain flatness of the antenna may be improved by adjusting the location of the feeding point 72 in the patch antenna 71.

Figure 8:
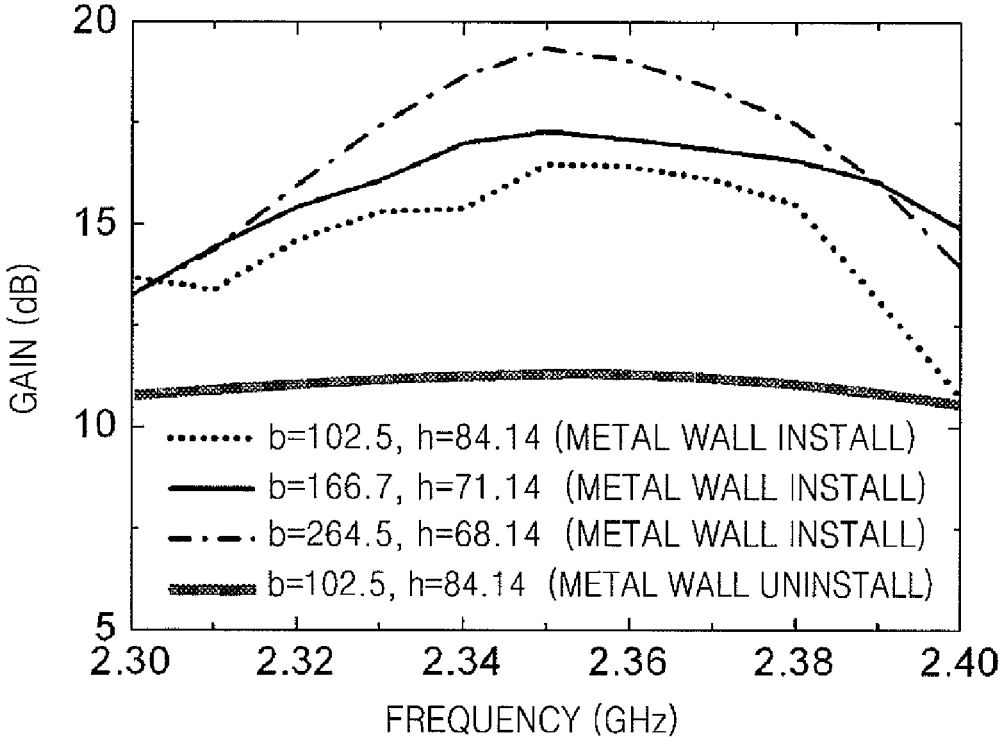
FIG. 8 shows an antenna gain according to size of the superstrate shown in FIG. 4 and whether the metal walls exist.

FIG. 8 shows an antenna gain according to size of the superstrate 1 shown in FIG. 4 and whether the metal walls 6 exist. As shown in FIG. 8, the antenna gain in a case when the metal walls 6 exist is greater than the antenna gain in a case when the metal walls 6 do not exist. Furthermore, it is clear that resonance distance h is also changed at a frequency of 2.35 GHz, at which the maximum gain appears, according to width b of the metamaterial superstrate 1 in the case when the metal walls 6 exist. The phenomenon contradicts a general notion that the resonance distance is constant regardless of the size of the superstrate in cases when the metal walls do not exist.

Figure 9:
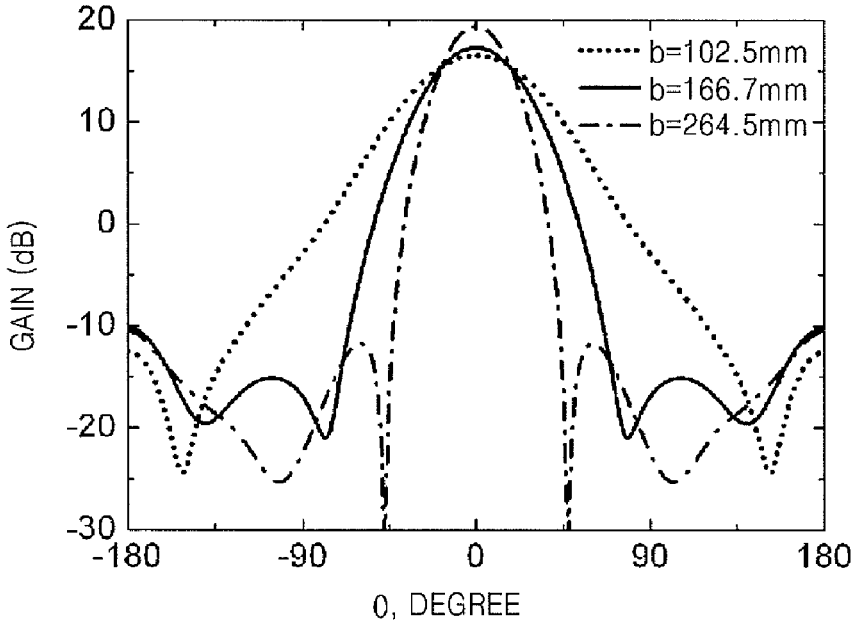
FIG. 9 shows antenna gains and radiation pattern characteristics according to width b of the superstrate.

FIG. 9 shows antenna gains and radiation pattern characteristics e according to width b of the superstrate 1. As shown in FIG. 9, when at frequency 2.35 GHz, the antenna gain increases and beam width decreases as width b increases. Furthermore, front-to-back ratio (FBR) is less than or equal to −30 dB.

Figure 10A:
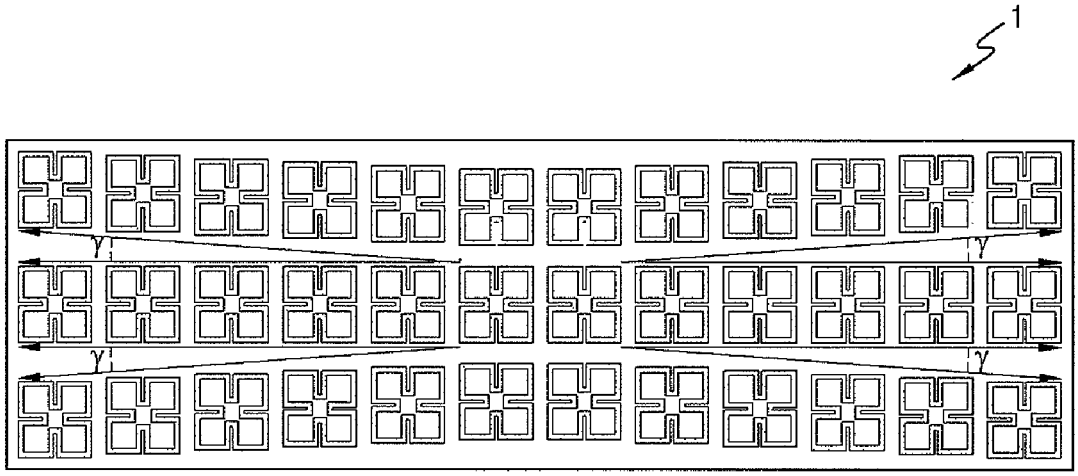
FIG. 10A shows an array of the unit conductive patterns, each of which is arranged at a predetermined angle with respect to the center array on the superstrate.

FIG. 10A shows an array of the unit conductive patterns 11, each of which is arranged at an angle γ with respect to the center array on the superstrate 1. Namely, the unit patterns of the same size are arranged symmetrically in both horizontal and vertical directions at a predetermined angle along a longitudinal direction of the superstrate from a center of the superstrate.

Figure 10B:
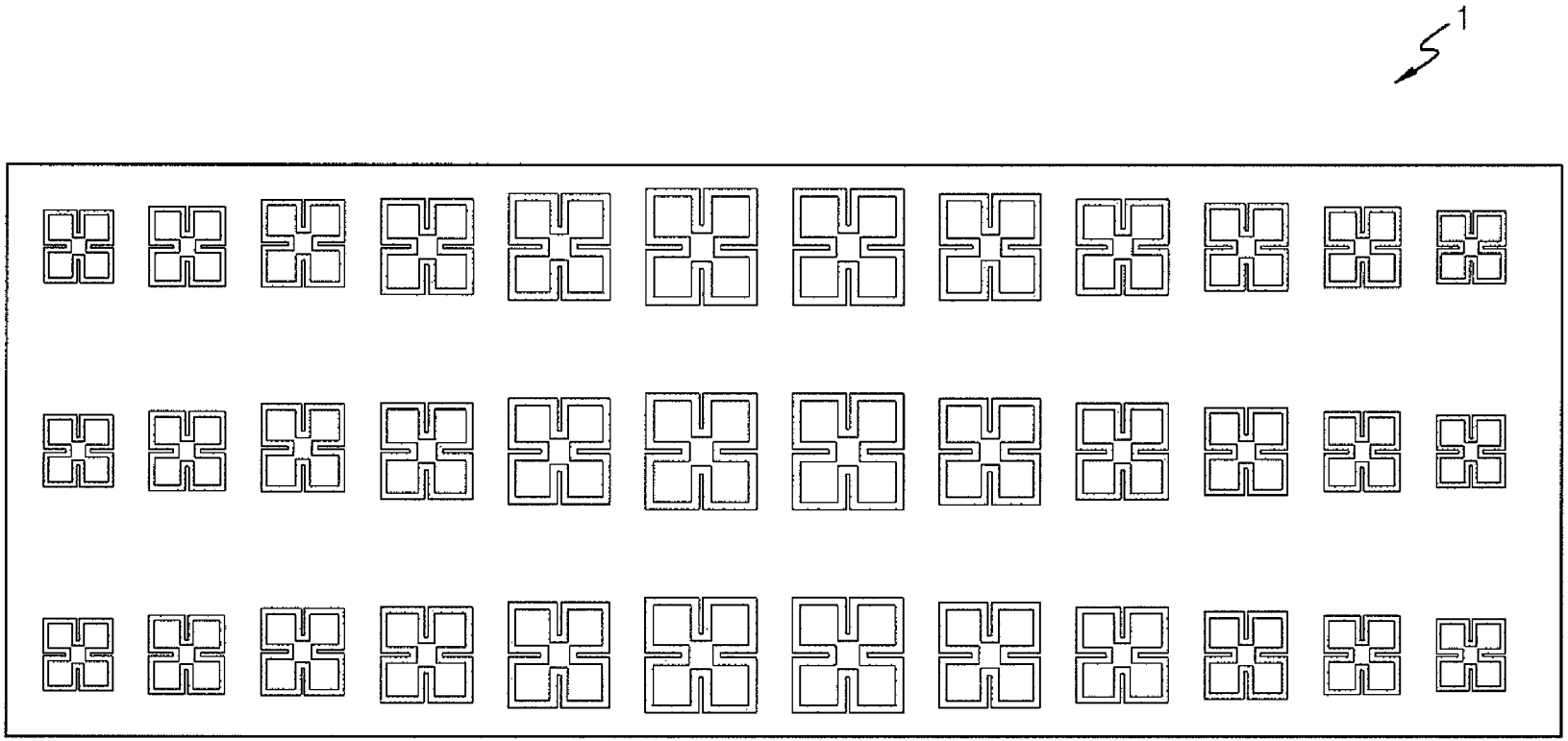
FIG. 10B shows an array of the unit conductive patterns whose sizes are decreased when they are disposed outward from the center of the superstrate.

FIG. 10B shows an array of the unit conductive patterns 11 whose sizes are decreased when they are disposed outward from the center of the superstrate 1. Namely, the unit patterns of different sizes are arranged along a longitudinal direction of the superstrate from the center of the superstrate.

As shown in FIGS. 10A and 10B, the gain flatness may be adjusted by either arranging the unit conductive patterns 11 at a predetermined angle with respect to the center array or arranging the unit conductive patterns 11 such that the sizes of the unit conductive patterns 11 increase or decrease along predetermined directions.

Figure 11:
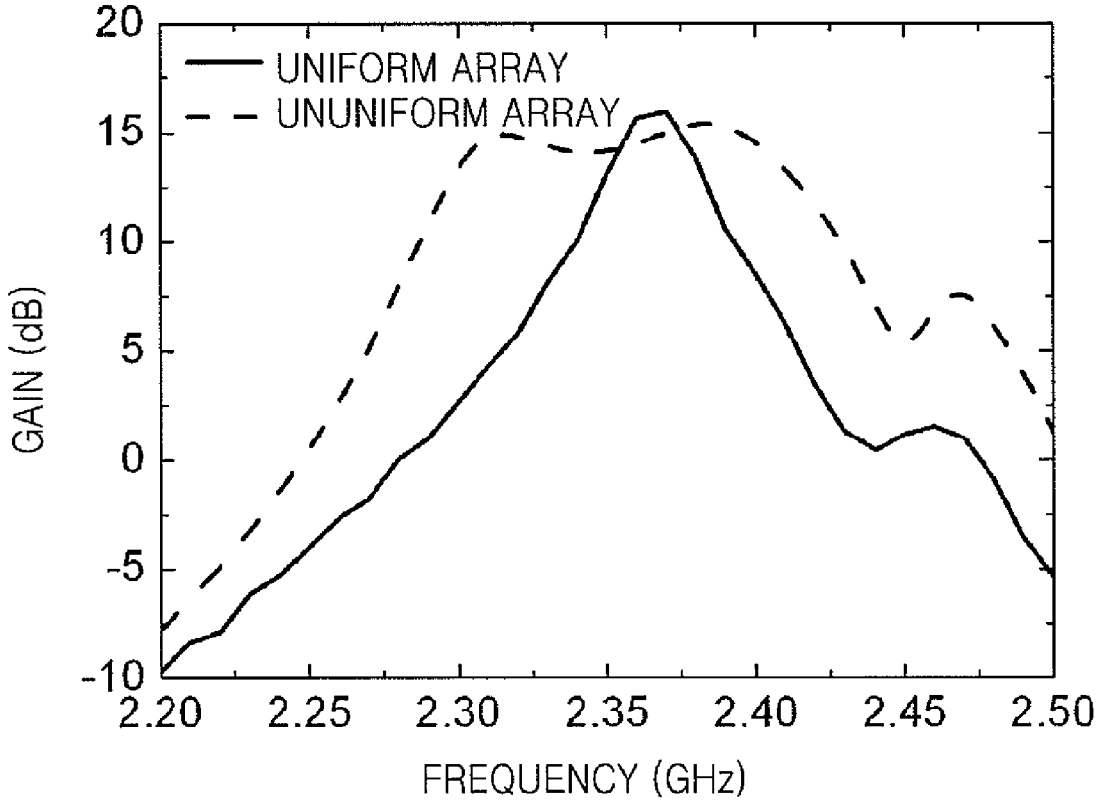
FIG. 11 shows gain flatness in a case where the conductive patterns are uniformly arranged on the superstrate and a case where the conductive patterns are not uniformly arranged on the superstrate.

FIG. 11 shows gain flatness in a case where the conductive patterns 11 are uniformly arranged on the superstrate 1 and a case where the conductive patterns 11 are not uniformly arranged on the superstrate 1, such as shown in FIG. 10A or FIG. 10B. As shown in FIG. 11, gain flatness is improved when the unit conductive patterns 11 are not uniformly arranged as compared to when the unit conductive patterns 11 are uniformly arranged.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An antenna comprising:

a resonator in which a feed antenna is located; and a superstrate comprising:

a dielectric substrate; and a conductive pattern on the dielectric substrate, the conductive pattern comprising:

a width;

a square-like outer perimeter; and four rectangular concave portions directed inwards towards a center of the conductive pattern in which each concave portion having a length and an interval separation gap such that the conductive pattern exposes five square areas of the dielectric substrate within the confines of the conductive pattern, wherein the conductive pattern on the resonator for improving gain and beamforming of the feed antenna.

2. The antenna of claim 1, wherein the conductive pattern is located on a top portion of the dielectric substrate.

3. The antenna of claim 1 the superstrate further comprises a plurality of conductive patterns on the dielectric substrate.

4. The antenna of claim 3, wherein the all of the conductive patterns have substantially the same size and are arranged symmetrically along both horizontal and vertical directions at a predetermined angle along a longitudinal direction of the superstrate from a center of the superstrate.

5. The antenna of claim 3, wherein the the conductive patterns have different sizes and are arranged along a longitudinal direction of the superstrate from the center of the superstrate.

6. The antenna of claim 1, further comprising metal walls on sidewalls of the resonator in a longitudinal direction of the antenna.

7. The antenna of claim 1, further comprising a plurality of conductive patterns on the dielectric substrate located on both a top portion and a bottom portion of the dielectric substrate.

8. The antenna of claim 1, further comprising a plurality of conductive patterns on a top portion of the dielectric substrate.

9. The antenna of claim 3, wherein the conductive patterns having substantially identical sizes and are arranged symmetrically in both horizontal and vertical directions at a predetermined angle along a longitudinal direction of the superstrate from a center of the superstrate.

10. The antenna of claim 8, wherein the conductive patterns of having substantially different sizes and are arranged along a longitudinal direction of the superstrate from the center of the superstrate.

11. The antenna of claim 1, wherein the feed antenna is selected from the group consisting of a patch antenna, a dipole antenna, a slot antenna and a waveguide antenna.

12. The antenna of claim 1, wherein the feed antenna is disposed inside the resonator.

13. The antenna of claim 1, wherein the feed antenna is disposed on top of the resonator.

14. The antenna of claim 1, further comprising:

a dielectric base disposed on the resonator; and a ground panel disposed on the dielectric base.

15. The antenna of claim 14, further comprising metal walls on sidewalls of superstrate, the resonator, the dielectric base and the ground panel.

16. The antenna of claim 1, wherein a gain of the antenna is adjusted in accordance to the width of the conductive pattern, the length of each concave portion, and a size of the interval separation gap.

17. The antenna of claim 3, wherein the conductive patterns of have different widths.

18. The antenna of claim 1, wherein four of the five square areas of the dielectric substrate exposed within the confines of the conductive pattern are sized substantially the same.

19. An antenna comprising:

a resonator;

a dielectric substrate disposed on top of the resonator;

a plurality of conductive patterns disposed on top of the resonator, wherein each conductive pattern comprising:

a width;

a square-like outer perimeter; and four rectangular concave portions directed inwards towards a center of the conductive pattern in which each concave portion having a length and an interval separation gap such that the conductive pattern exposes five square areas of the dielectric substrate within the confines of the conductive pattern; and a feed antenna disposed within the antenna.

20. The antenna of claim 19, further comprising:

metal walls on sidewalls of the resonator;

a dielectric base disposed on the resonator; and a ground panel disposed on the dielectric base.

* * * * *